US006198227B1

(12) United States Patent
Salavin et al.

(10) Patent No.: US 6,198,227 B1
(45) Date of Patent: Mar. 6, 2001

(54) METHOD FOR CONTROLLING AN ALTERNATING PLASMA DISPLAY PANEL INCORPORATING IONIZATION

(75) Inventors: Serge Salavin, Saint Egreve; Lionel Thavot, Moirans, both of (FR)

(73) Assignee: Thomson Licensing S.A., Boulogne Cedex (FR)

( * ) Notice: Subject to any disclaimer, the term of this patent is extended or adjusted under 35 U.S.C. 154(b) by 0 days.

(21) Appl. No.: 09/508,774

(22) PCT Filed: Sep. 25, 1998

(86) PCT No.: PCT/FR98/02065

§ 371 Date: Mar. 14, 2000

§ 102(e) Date: Mar. 14, 2000

(87) PCT Pub. No.: WO99/17269

PCT Pub. Date: Apr. 8, 1999

(30) Foreign Application Priority Data

Sep. 30, 1997 (FR) ..... 97 12133

(51) Int. Cl.[7] ..... G09G 3/10

(52) U.S. Cl. ..... 315/169.4; 315/169.1; 345/67; 345/68; 345/204

(58) Field of Search ..... 315/169.1, 169.2, 315/169.4; 345/37, 55, 67, 68, 60, 204, 214

(56) References Cited

U.S. PATENT DOCUMENTS 3,979,638 9/1976 Ngo ..... 315/169
5,030,888 * 7/1991 Salavin et al. ..... 315/169.4
5,075,597 * 12/1991 Salavin et al. ..... 315/169.4
5,086,257 * 2/1992 Gay et al. ..... 315/169.4
5,099,173 3/1992 Kim et al. ..... 313/585
5,436,634 7/1995 Kanazawa ..... 345/67
5,854,540 * 12/1998 Matsumoto et al. ..... 315/169.1

FOREIGN PATENT DOCUMENTS 0549275 6/1993 (EP) .
2657713 8/1991 (FR) .
2694118 1/1994 (FR) .
97/28526 8/1997 (WO) .

* cited by examiner

*Primary Examiner*—Haissa Philogene
(74) *Attorney, Agent, or Firm*—Joseph S. Tripoli; Harvey D. Fried; Sammy S. Henig

(57) ABSTRACT

A method for the control of a color alternating display panel having a written state and an extinguished state arranged in rows and columns, the rows forming at least two sets. A sustaining signal is applied to the rows. This sustaining signal generates discharges in the cells that are written in. The sets are addressed. An addressing operation consisting of a semi-selective operation followed by a selective operation. After a semi-selective operation pertaining to the first set, a preconditioning write operation is performed on the cells of one row of the second set, aimed at ionizing the panel. Application in particular to plasma panels.

20 Claims, 7 Drawing Sheets

METHOD FOR CONTROLLING AN ALTERNATING PLASMA DISPLAY PANEL INCORPORATING IONIZATION

The present invention relates to a method for the control of a color alternating display panel integrating an ionization effect.

BACKGROUND OF THE INVENTION

This method can be applied especially to color plasma panels displaying a large number of half-tones and having a large size (more than one meter diagonal) for television applications.

Plasma panels work on the principle of an electrical discharge in gases. They comprise two insulating slabs each bearing at least one array of electrodes and mutually demarcating a gas-filled space. The slabs are joined to each other in such a way that the arrays of electrodes are substantially orthogonal, one representing rows and the other columns. Each intersection of electrodes defines a cell to which there corresponds a small gaseous space. A given cell is turned on by the selection of two crossed electrodes to which, at a given instant, appropriate voltage are applied so that, between these electrodes, the potential difference prompts a discharge in the gas and a light emission. The cells are positioned in rows and columns.

To obtain a color panel, strips of luminophore materials that correspond to the green, red and blue colors and are excitable by ultraviolet radiation are deposited and a gas is used, emitting ultraviolet rays during the discharge. A system of barriers between the strips is used for the physical demarcation of the cells of the panel and to limit the phenomena of the diffusion of one color over another. A video pixel consists of a triplet of cells (one red, one green and one blue).

The discharges in a plasma display panel are initiated properly if the gaseous medium in which they occur is ionized. The display panels that are being developed presently for these television applications are so-called alternating plasma panels. In these panels, the electrodes that bear the slabs are insulated from the discharge gas by a dielectric layer, generally based on magnesia.

A sustaining signal formed by a succession of square-wave signals is permanently applied to all the rows. This has the effect of maintaining each cell in the state assigned to it during an addressing phase. The addressing, which consists either of the selective lighting up or the selective extinguishing of the cells of the panel, is done in sets of one or more rows and each row is scanned several times during the period of display of an image or an image cycle.

It turns out to be the case that these color plasma display panels, in part because of the nature of the gas mixture and in part because of the technology, show difficulties in the lighting up of certain cells according to a probabilistic relationship. The gaseous mixture of the color panels is generally a mixture of neon and xenon with about 10% of xenon. This mixture distributes the ionization poorly.

During the addressing phase, certain cells are not lit up when they should be lit up, or they take more time to get lit up and, during the sustaining phase, the lighting up is not done or takes place randomly or in a deferred manner. The image displayed therefore has defects.

With regard to the structure of the panel, the cells are demarcated by barriers that have a role of confinement, i.e. they are designed firstly to prevent the discharges from propagating towards the neighboring cells which should not be lit up and secondly to prevent the ultraviolet radiation created by a discharge in a given cell from exciting the luminophores of neighboring cells and generating a lack of saturation of the colors. These confinement barriers are not appropriate for the diffusion of ionization even if their height is smaller than the spacing between the two slabs and even if they extend along a single array of electrodes.

The nature of the dielectric layer in contact with the gas mixture has the specific feature of possessing a high coefficient of secondary emission assisting in the starting of the discharge but this effect is not sufficient to resolve this problem of ionization.

In monochromatic alternating plasma display panels, this problem of ionization does not arise if, all around the panel in a frame concealed from the observer, there are provided conditioning cells that are permanently lit according to specified voltage levels and a specified chronology.

Within these cells, discharges are constantly initiated, furthering the ionization of all the gas contained in the space demarcated by the slabs. These conditioning cells are efficient even if the panel is a large-sized panel. It must be remembered that, in monochromatic panels, the gas mixture is generally neon and argon with about 0.2% of argon and its role in the diffusion of the ionization is important.

The transposition of these conditioning cells outside a useful zone in a color alternating plasma panel brings practically no improvement to this problem of ionization.

There also exist direct current plasma panels in which the electrodes are in contact with the gas mixture. Each cell is partitioned off, and the problem of ionization is even more crucial. This problem has been resolved only by placing, beside each useful cell 1 that can be seen by the observer, a conditioning cell 2 masked from the observer. The lighting up of a conditioning cell 2 precedes that of a neighboring useful cell 1. One conditioning cell is generally provided for two useful cells. A cross-section of a panel of this kind is presented in FIG. 1. The two slabs bear the reference 10*a*, 10*b*. Each of them bears an array of useful electrodes 11*a*, 11*b*. Each intersection of useful electrodes 11*a*, 11*b* defines a useful cell 1. Partition walls 3 firstly separate two neighboring useful cells 1 and secondly have a brace function to ensure the efficient positioning of the slabs 10*a*, 10*b*. Each useful cell 1 is the neighbor of a conditioning cell 2. It is separated therefrom by a barrier 4 whose height is smaller, in part, than the distance between the two slabs 10*a*, 10*b*. A conditioning cell 2 is defined by the intersection of one of the electrodes 11*a* which is used also to define a useful cell 1 and a conditioning electrode 5.

A diagrammatic view has been shown of a conditioning discharge 6 that occurs in the conditioning cell 2 and precedes a useful discharge 7 that occurs in the useful cell 1 to the right. The conditioning discharge 6 is concealed from the observer (represented diagrammatically by an eye) for the slab 10*b* facing the observer carries a black matrix 8 to form a shield against the conditioning discharges 6. The conditioning discharge 6 initiates the useful discharge by pre-ionizing the gas mixture contained between the two slabs 10*a*, 10*b*.

This structure with conditioning cells requires an array of electrodes and additional electronic circuits. It gives rise to greater electrical consumption and makes a greater amount of electrical power available.

Another drawback is that the minimum pitch between two useful cells 1 separated by a conditioning cell 2 is dictated by the size of this conditioning cell 2. Space is lost.

From the viewpoint of advantages, since the conditioning discharges are masked with respect to the observer, they introduce no inconvenient luminous background that would reduce the contrast.

Another advantage is that the addressing of the conditioning cells is separated from that of the useful cells, thus making it possible to avoid using the time devoted to the addressing of the useful cells for the addressing of the conditioning cells. It must be borne in mind that the greater the number of rows of the panel the smaller should be the amount of time devoted to the processing of a row or the greater should be the number of rows processed at the same time.

Since the problem of ionization encountered in the color alternating plasma display panels is not as crucial as in panels that have direct-current type operation, it does not seem to be necessary to introduce the conditioning cells into the vicinity of each useful cell because of all the technological and electronic complications that they give rise to.

It has been proposed, in the alternating color plasma display panels described in the patent application EP-A1-0 549 275, filed by FUJITSU, to provide for a non-selective ionizing phase before each addressing phase. This means that this phase is applied simultaneously to all the rows.

FIG. 2 provides a diagrammatic view of the processing operations applied to all the rows of a display panel of this kind.

During an image cycle which is the time needed to display an image, all the rows are simultaneously ionized and then addressed and then sustained. These three phases of ionizing, addressing, and sustaining form one cycle and several cycles are repeated during an image cycle. So as to make it possible to display the half-tones, the sustaining phases of the different cycles have different durations.

This phase of ionization consists of various operations to light up all the cells of the panel, these lighting-up operations alternating with various operations of extinguishing all the cells of the panel.

In the drawing, the ionization phase is represented by hatches, the addressing phase by strokes and the sustaining phase by dots.

Apart from the fact that the cycle time is extended, these ionization phases create a relatively strong luminous background on the screen, the contrast between the lit cells and the extinguished cells being about 100.

In the color alternating plasma display panels in which the scanning operations are interlaced, it is not possible to position this non-selective ionization phase simultaneously on all the rows since the addressing and sustaining phases are temporally mixed with each other. At a given instant, not all the rows are processed in the same way.

SUMMARY OF THE INVENTION

The present invention proposes a method for the control of a color alternating display panel with a pre-ionizing phase compatible with interlaced scanning operations, this method being designed to minimize the luminous background and prevent a reduction of the time allocated to the addressing.

More specifically, the present invention relates to a method for the control of a color alternating display panel comprising cells arranged in rows and columns, the rows forming at least two sets, these cells having two states, one written and the other extinguished. It comprises at least the following steps:

the application, to the rows, of a sustaining signal formed by a succession of cycles generating sustaining discharges in the cells that are written in, the addressing, at appropriate points in time, of the sets, an addressing consisting of a semi-selective operation followed by a selective operation, wherein after at least one semi-selective operation pertaining to the first set, a preconditioning write operation is performed on the cells of at least one row of the second set, whatever the state of the cells of the row, this preconditioning write operation taking place outside an addressing time of the second set and outside the selective operation that follows the selective operation pertaining to the first set.

The sustaining signal comprises plateaux linked by edges acting as transitions. Preferably, if it is not desired to increase the time allocated to the addressing, the preconditioning write operation is done by a pulse superimposed on a plateau, just after a transition, at a point in time in which there should be a sustaining discharge in the written-in cells of this row, in the absence of any preconditioning write operation.

If time is not of critical importance, it is of course possible to place the preconditioning pulse at another place on the plateau.

To reduce the luminous background provided by this preconditioning write operation, it is seen to it that this write operation occurs as closely as possible to an erasure operation applied to the second set. However it is preferable for the preconditioning write operation to take place at least one sustaining cycle before this erasure operation so as not to disturb its effects.

Since a write operation is also carried out by means of a pulse superimposed on a plateau, it is possible, in order to minimize the number of sustaining cycles between the preconditioning write operation and the erasure operation, to envisage giving different amplitudes to the preconditioning pulse and to the write pulse.

In order to display half-tones, each set is subjected to several successive operations, a processing operation consisting of an addressing processing operation followed by at least one sustaining cycle, each processing operation being associated with a control bit whose value represents the processing time.

To simplify the control of the panel, it is possible for the two sets to be processed one after the other by the same bit.

In order to avoid excessively increasing the luminous background of the panel, it is possible to carry out the preconditioning write operation only during one or more processing operations of the first set, these processing operations being preferably associated with low-value bits.

In order to make the luminous background homogeneous, it is advantageous that the written-in row of the second set should change according to the processing bit of the first set. This change may take place within the same second set of rows, for example by permutation among the rows of the second set.

This change may also take place within several sets of rows.

To further improve the ionization of the panel at the edge of the image, especially if it is a large-sized panel and without increasing the luminous background, it may be planned that the signals will keep at least one additional row of the display panel, located on one edge, in a permanently lit state. This row is concealed from an observer and is used only for this function.

The present invention also relates to a display panel implementing the method described here above. A panel of this kind comprises at least one array of row electrodes or rows intersecting with at least one array of column electrodes or columns, a row management device and a column management device delivering signals respectively to the rows and to the columns, the row management device comprising at least one sustaining generator that delivers sustaining signals to all the rows by means of one or more row control circuits or <<row drivers>>, each row being connected to an output of a row driver, wherein the display panel also comprises an addressing circuit supplying the rows, through an output to be activated of one of the addressee row drivers, after an enabling of the addressee row driver, with the signals that are superimposed on the sustaining signals, these signals being of three types: erasure signals, write signals and preconditioning write signals.

The addressing circuit may comprise:

a signal generator delivering signals of the three types, means to deliver, firstly, each signal accompanied by an identification of an addressee row driver and, secondly, each signal accompanied by an identification of one or more outputs, to be activated, of a row driver, first means for the sequential transmission, at a selected point in time, of each signal accompanied by the identification of the addressee row driver to said addressee row driver, second means for the sequential transmission, at the same selected point in time, of a signal of the same type accompanied by the identification of said output or outputs to be activated towards said output or outputs to be activated of all the addressee row drivers having one or more such outputs.

A row driver will then enable the transmission of a signal received from the second means of sequential transmission towards the row corresponding to the output to be activated when it has received, at the same point in time, the signal of a same type coming from the first sequential transmission means.

According to one variant that makes it possible to save time, the addressing circuit may comprise:

a signal generator delivering signals of three types, means to deliver, firstly, each signal accompanied by an identification of an addressee control circuit and, secondly, each signal accompanied by an identification of one or more row driver outputs to be activated, means for the sequential transmission, at a selected point in time, of each signal accompanied by the identification of the addressee control circuit towards said addressee control circuit, means for the simultaneous routing, in packets of three different types, of the signals accompanied by the identification of said output or outputs to be activated towards said output or outputs to be activated of the addressee row driver.

A row driver will enable the transmission of a signal received at one of its outputs, towards the corresponding row, at the selected point in time when it will receive a signal of the same type from the sequential transmission means.

BRIEF DESCRIPTION OF THE DRAWINGS

Other features and advantages of the invention shall appear from the following description of an exemplary embodiment illustrated in the appended figures, of which.

DETAILED DESCRIPTION OF THE PREFERRED EMBODIMENTS

Throughout the description and claims, the rows and columns of the display panels may be interposed.

Figure 1:
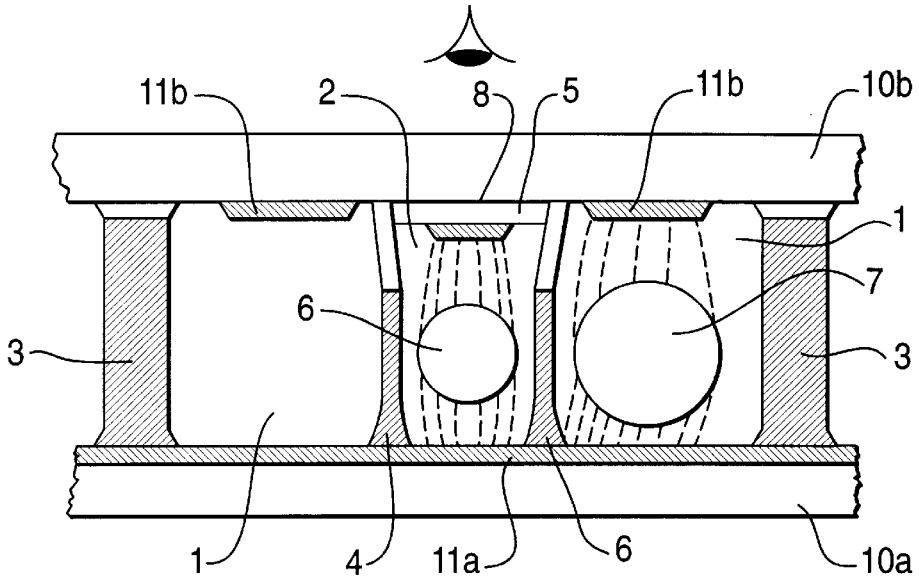
FIG. 1 (already described) shows the structure of a direct-current plasma display panel.
Figure 3B:
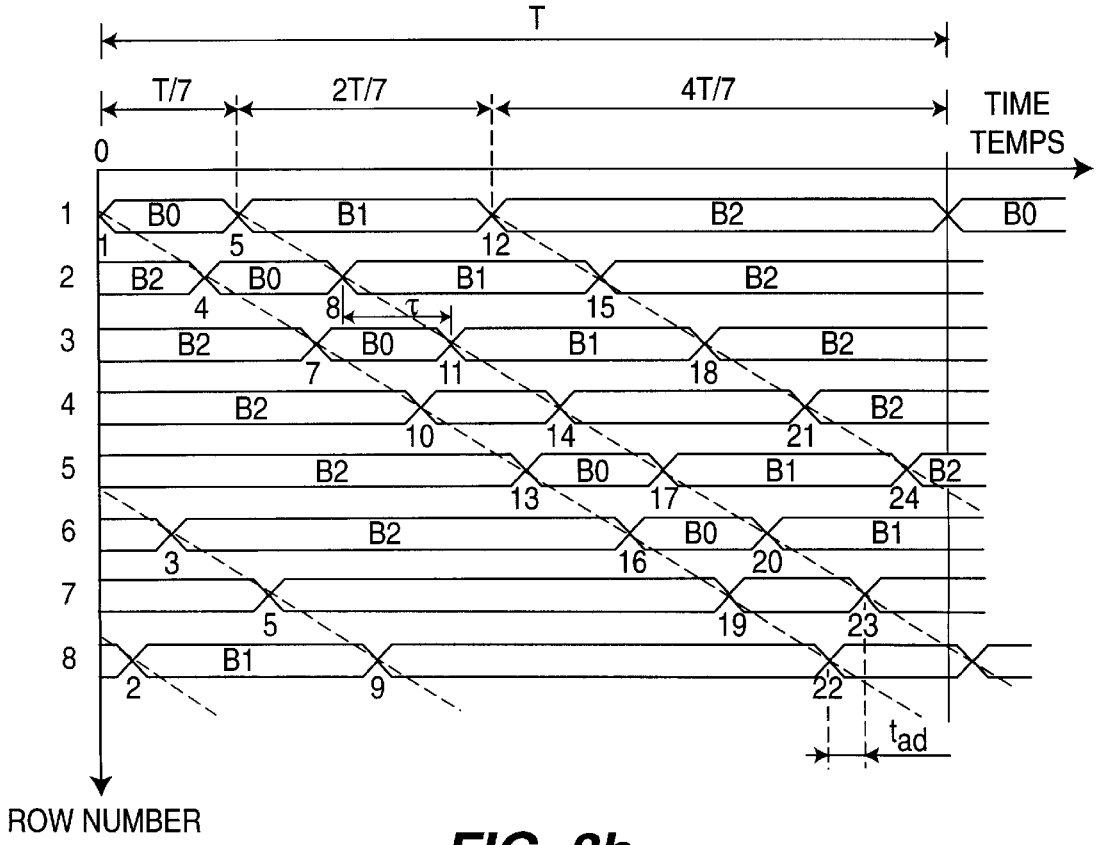
FIG. 3*b* shows the principle of interlacing scanning operations.
Figure 2:
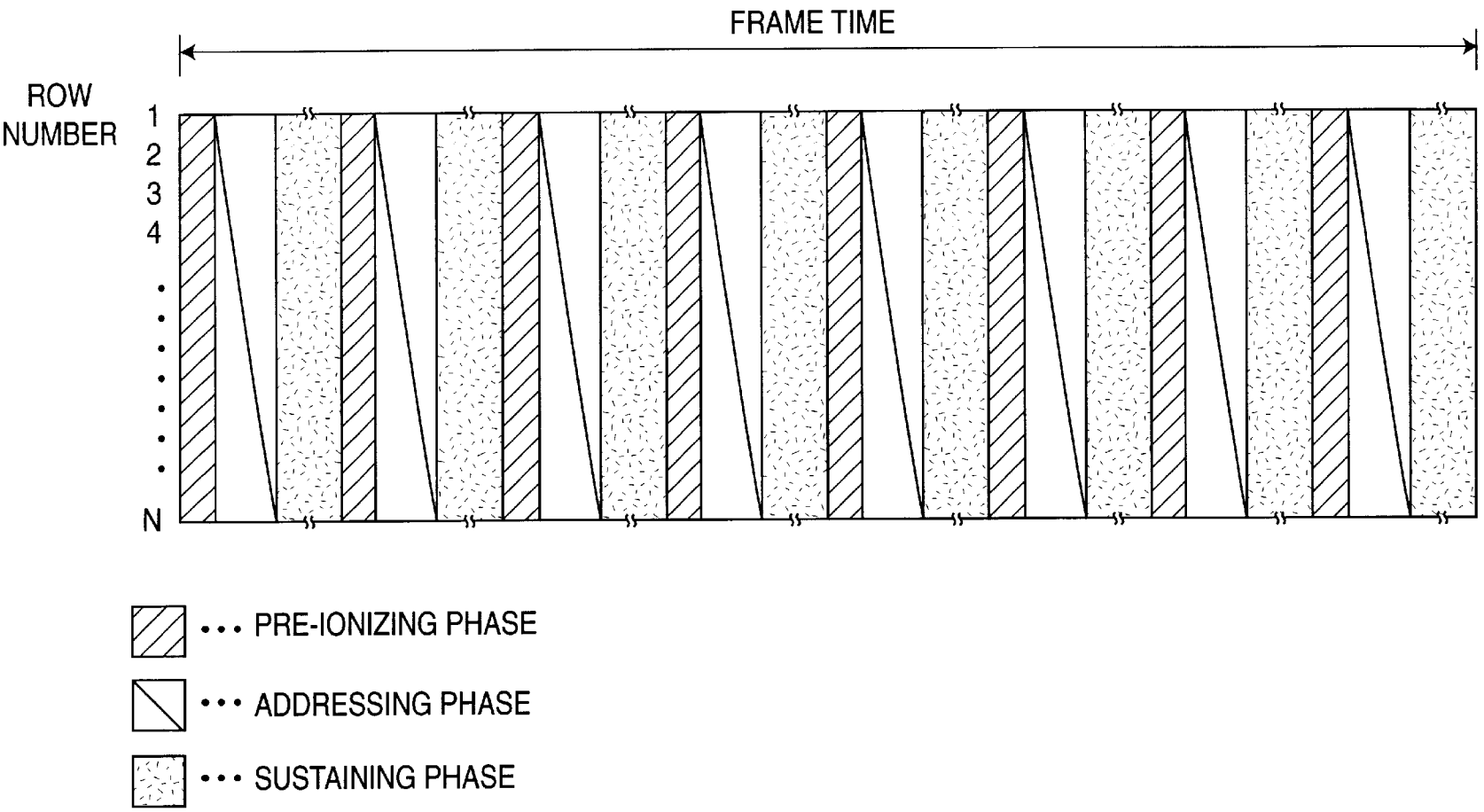
FIG. 2 (already described) shows the different processing operations applied to an alternating display panel in which all the rows undergo the same treatment at the same time.
Figure 3A:
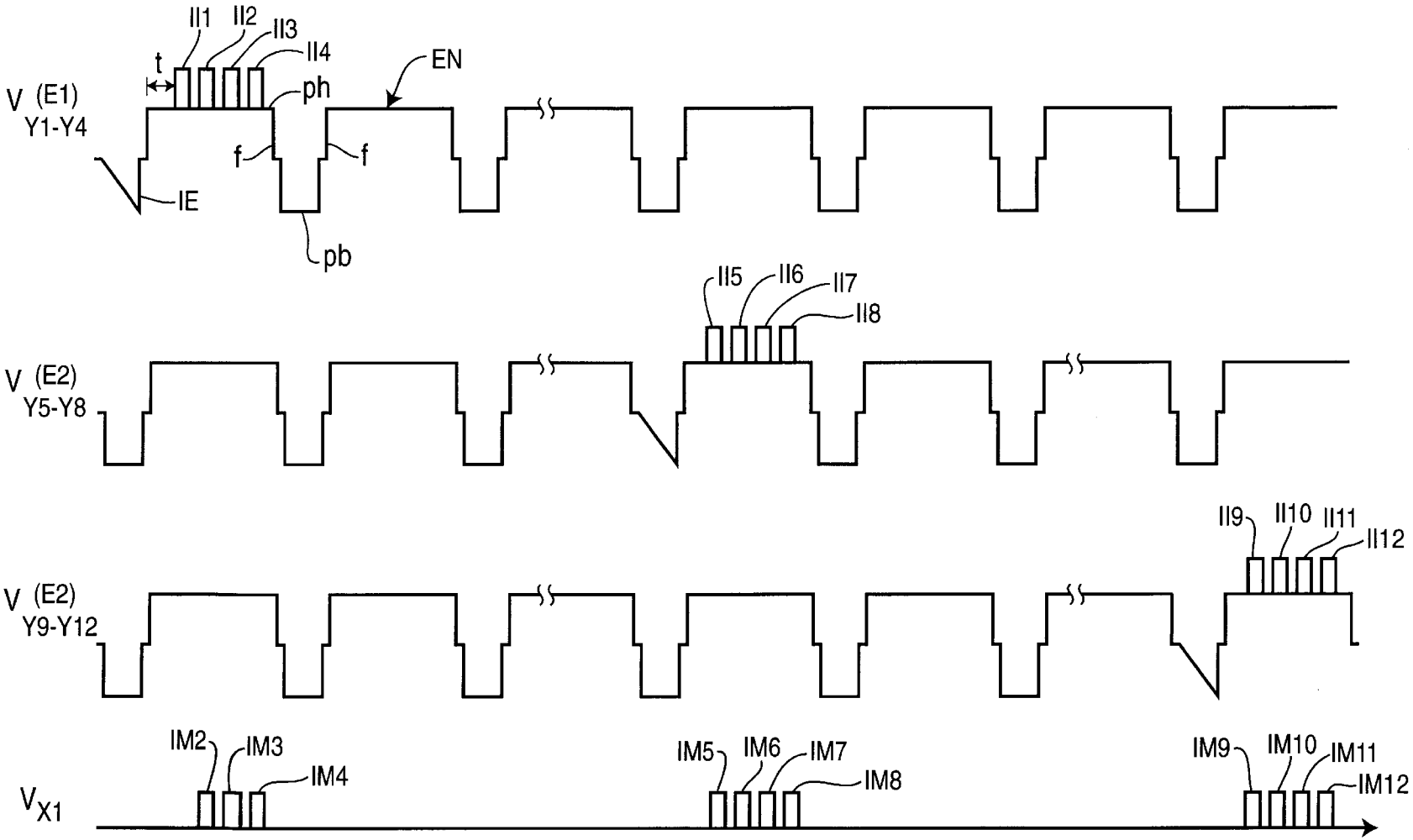
FIG. 3*a* is a timing diagram showing the instants of addressing of some rows of an alternating display panel controlled in a standard way with interlaced scanning operations.

FIG. 3*a* is a timing diagram showing the points in time for the addressing of the rows of an alternating color display panel that is controlled, in a standard way, with interlaced scanning operations and can be controlled by the method according to the invention.

A sustaining signal is applied to the row. This sustaining signal is formed by a sequence of sustaining cycles EN in square-wave form. Its effect is to keep each cell in the state that has been assigned to it during an addressing operation.

The addressing operation is carried out the rows, set by set. A set of rows comprises one or more rows. If the panel is a large-sized panel each set preferably has several rows. In the example described, each set E1, E2, E3 has four rows Y1–Y4, Y5–Y8, Y9–Y12.

The addressing consists in modifying the voltage at the terminals of the cells in order to erase them or to write in them. It comprises a semi-selective operation consisting for example in extinguishing all the cells of a set followed by a selective operation consisting for example in writing in only those cells that have to be written in. The selective operation makes it possible to differentiate between the different cells of a row to act on only some of them. Hereinafter, it is assumed that the erasure is semi-selective and that the write operation is selective. It is also possible for the erasure to be selective and the write operation to be semi-selective.

The operation for the erasure of the rows Y1–Y4 of a set E1 consists in superimposing a pulse IE on the sustaining square-waves EN that are received by this set E1. The operation for writing in certain cells of a row Y2 consists in superimposing a pulse II2 on the sustaining square-wave EN received by this row Y2 but also in applying pulses to the columns corresponding to the cells of the row that do not have to be written in and nothing to the columns corresponding to the cells that have to be written in. It is then possible to differentiate between the different cells of the row.

A pulse IM2 on the column X1 conceals the voltage pulse II2 applied to the row Y2 for the cell located at the intersection of the row Y2 and the column X1 and the cell that remains extinguished.

In FIG. 3*a*, it can be noted that since the rows are processed four by four, a sustaining cycle EN in square-wave form has a low plateau pb that is relatively short followed by a high plateau ph that is longer. There is a transition f between two successive high and low plateaux.

The erasure pulse IE takes place during a low plateau pb. It is unique for all the rows Y1, Y2, Y3, Y4 of the set addressed.

By contrast, during the high plateau ph that follows, several pulses II1, II2, II3, II4 designed for writing are generated successively. The first pulse II1 is applied to the row Y1, the second pulse II2 to the row Y2, etc. The same pulses II5 to II12 designed for writing on the rows Y5 to Y12 are found again. The erasure pulse could occur on a high plateau and the pulses that contribute to the writing could occur on the low plateaux.

These pulses designed for writing get combined with those received in synchronism by the columns. It is assumed in the example of FIG. 3*a* that only the cell located at the intersection of the row Y1 and the column X1 will be written in. Those located at the intersection of the column X1 and the rows Y2 to Y12 will be extinguished. They receive pulses IM2 to IM12 at the column X1 in synchronism with the pulses II2 to II12.

It can also be noted that, between the beginning of the high plateau ph and the first pulse II1 aimed at writing, there is provided a free time interval t. During this free time interval t, no addressing is done. The duration of this free time interval t corresponds approximately to that of a pulse designed for the writing. This free time t represents the time needed to set up discharges for the sustaining of the written-in cells of the panel belonging to set other than the one addressed. The sustaining discharges occur at the end of a transition f leading to a furthest high plateau ph or furthest low plateau pb.

The risk of applying a pulse to a column during this time interval t is not taken. This pulse would disturb all the cells of this column which, at this point in time, are sustained.

FIG. 3*b* gives a diagrammatic view, in a timing diagram, of the known principle of interlaced scanning operations used to obtain half-tones.

It is assumed in the example described that the panel has eight rows, displays eight half-tones $2^3$ and that a set of rows comprises only one row. To display these half-tones, each of the rows must be processed three times during the image cycle, each processing operation starting by an addressing operation that takes place at accurately selected points in time. These different processing operations begin with an addressing operation used to modulate the duration of the lighting up of the cells of the panel. To display a full image, 24 processing operations beginning with an addressing operation will be needed. They are numbered in the diagram from 1 to 24.

For one set of rows, each processing operation that begins with an addressing operation is associated with a control bit whose value represents the duration of the lighting up of the cells lit up by this addressing operation.

In the example described, three bits B0, B1, B2 are used. The addressing operations have been represented as being localized operations without separating the erasure from the writing.

The time taken for addressing a cell is the same for all the bits whatever their value. What changes is the duration of the processing operation, namely the duration for which the cell is kept lit or extinguished. Thus, the processing by the bit B0 lasts T/7, the processing by the bit B1 lasts 2T/7 and the processing by the bit B2 lasts 4T/7. It may be recalled that T represents the duration of an image cycle.

A sequencing algorithm makes it possible to address all the rows three times in maintaining the value of the bit concerned between two successive operations of addressing the same row.

Thus, while the first row is processed by the bit B0, the eighth row is processed by the bit B1 and then the sixth row by the bit B2 and then the second row by the bit B0.

It will be observed that one and the same time interval $\tau$ separates two successive operations for the addressing of two sets of rows processed by the same bit, whatever the value of the bit.

Let tad be the time interval between two successive addressing operations of two sets of rows by different bits. The time interval $\tau$=ntad with n equal to the number of bits used for the half-tones.

Figure 4:
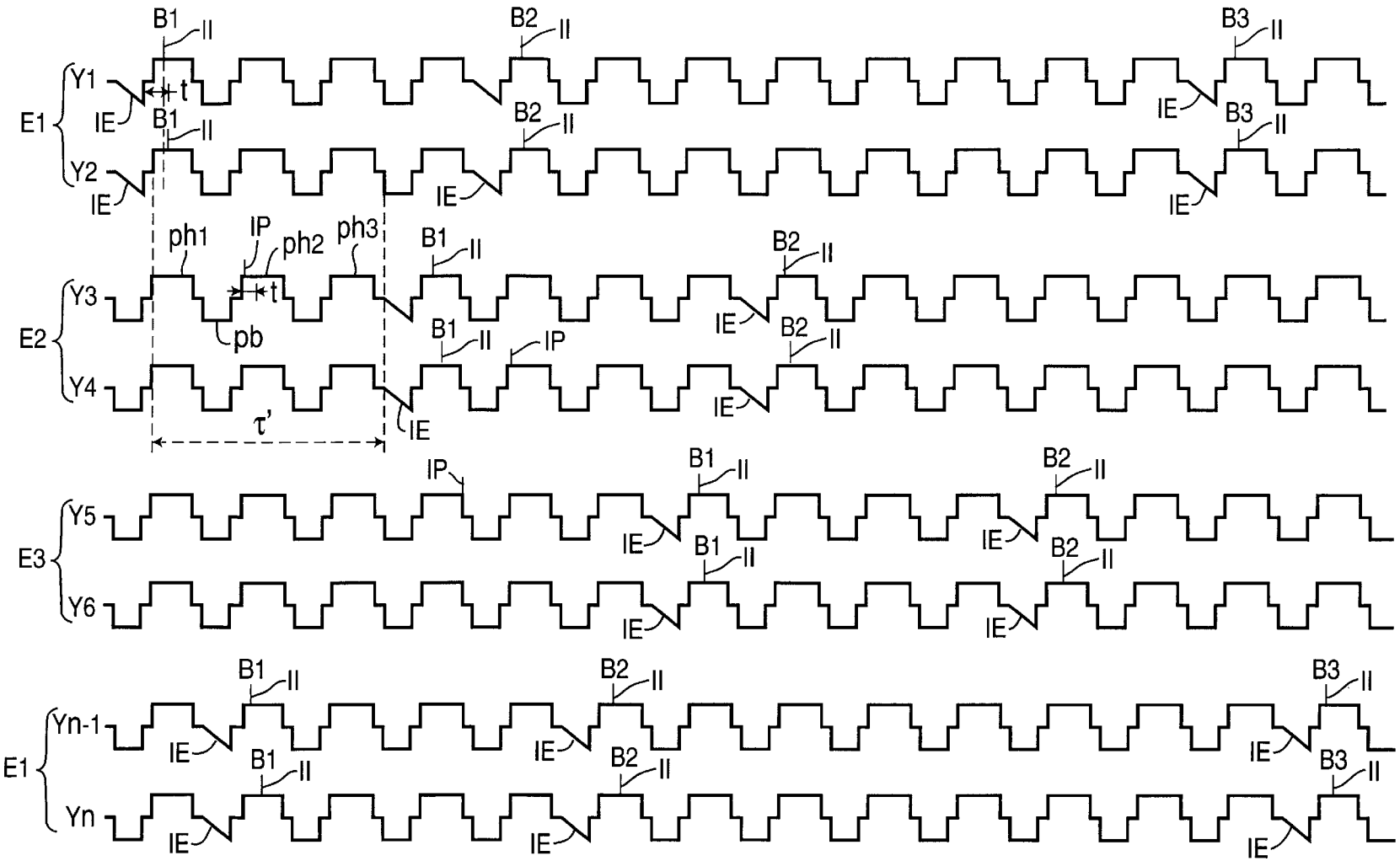
FIG. 4 is a timing diagram showing the processing of some rows of a display panel controlled by the method according to the invention.

We shall now refer to FIG. 4 which, in the same way as FIG. 3*a*, shows the processing of several rows by the method according to the invention. Now, one set E1, E2, E3, . . . , Em of rows comprises two rows and the sets E1, E2, E3, . . . , Em shown correspond to eight rows Y1 to Y6, Yn-1, Yn.

After a semi-selective operation pertaining to the first set E1 of rows, a preconditioning write operation IP is carried out of the cells of at least one row Y3 of the second set E2, whatever the state of the cells of the row Y3. This preconditioning write operation IP takes place outside an addressing time of a second set and outside the selective operation that follows the semi-selective operation of the first set E1.

This preconditioning write operation IP achieves an ionization of the panel and improves the response time of the cells of the panel during a write operation or sustaining operation.

In the example described, the preconditioning writing IP of the row Y3 takes place during the processing of the bit B1 of the first set E1.

The second set E2 neighbors the first one and it is processed just after the first one E1 for the same bit B1. This means that the time bracket $\tau'$ during which the preconditioning write operation IP may have occurred is the same whatever the value of the bit. This is simple to implement. It is of course possible to write in a row of any other set of rows.

The preconditioning write operation IP of the row Y3 is initialized by a preconditioning pulse that is superimposed on the sustaining square-waves EN received by this row Y3. For clarity sake, the preconditioning pulse bears the reference IP for it is this pulse that can be seen in the figure. This is also the case for the erasure and write pulses during the addressing operations. This preconditioning pulse IP has an appropriate amplitude. By placing the preconditioning pulse IP during a free interval t at the beginning of the high plateau ph of the sustaining signal EN, there is a certainty of not disturbing the state of the cells of other rows since no writing is initialized at this point in time. In fact, the position of this preconditioning pulse IP during a free interval t at the beginning of the high plateau ph is the position which makes it definite that the entire row will be written in without modifying the time allocated to the addressing operation. If the addressing time is not of vital importance, it is possible to locate the pulse at another position of the high plateau ph.

A preconditioning write operation IP is thus found on the rows Y4, Y5, Y6 at appropriate points in time. On the row Y5, the preconditioning write operation IP can take place at the end of the plateau.

However, if a large number of rows takes part in the ionization, there is a risk of having a strong luminous background. This is troublesome. If, furthermore, it is always the same rows that participate in the ionization, the luminous background will have little homogeneity for these rows contributing to the ionization will appear to be over-bright.

To reduce this luminous background and improve its homogeneity, several approaches can be envisaged. They may be used separately or in combination. Everything depends on the size of the panel, the number of rows per set, the number of bits and the quality of the dielectric layer.

One of the approaches used to reduce the luminous background is to carry out this preconditioning write operation for only one half-tone bit or for some of them, preferably for the low-value bits because the ionization defects are present to a greater extent in cells processed by the bits assigned these low values. Thus, a reduction is obtained in the duration of the lighting up of the row contributing to the ionization since the duration of preconditioning illumination is directly proportional to the number of bits affected by the preconditioning. In FIG. 4, no preconditioning write operation is done during the processing of the bit B3 of the set E1 of rows.

Another approach to reducing the luminous background is to start the preconditioning write operation as late as possible. In the example described in FIG. 4, between the erasure of the rows of the set E1 and the erasure of the rows of the set E2, there are three sustaining cycles EN and there are therefore three successive high plateaux ph1, ph2, ph3 available to receive the pulse IP initializing the preconditioning writing of the row Y3. To reduce the lighting-up time of the row Y3, it is possible to envisage placing this pulse IP on the third high plateau ph3, the one closest to the erasure pulse IE of the rows of the second set E2.

It would however be wiser not to place the pulse IP for the preconditioning of the row Y3 at the beginning of this last high plateau ph3 if it is sought not to risk disturbing the erasure of certain cells of this row Y3.

When a write pulse is generated, charges are exchanged between the two facing slabs. When a sustaining discharge is made, there is also an exchange of charges between these two slabs but the number of charges brought into play during the write operation is different from that brought into play during the sustaining. Efficient erasure can take place only if it follows at least one sustaining cycle to stabilize the discharges. In the present example, it is preferable to place the preconditioning pulse IP on the second last high plateau ph2. The choice of the position of the preconditioning pulse IP is restricted in the example but, in panels displaying a large number of half-tones, the choice is much wider.

One way to minimize the number of sustaining cycles between the preconditioning write operation and the erasure consists, for example, in adapting the amplitude of the preconditioning pulse by giving it a different voltage value from that of the selective writing pulse.

To obtain greater homogeneity in the luminous background provided by the lighting up of rows that contribute to the ionization, it can be planned, for a set E1 of given rows, not to light up always the same row of the second set E2.

Thus, in the present example of FIG. 4, during the processing of the bit B1 of the first set E1, it is the row Y3 that contributes to the ionization whereas during the processing of the bit B2 it is the row Y4. A permutation between the rows Y3, Y4 of the second set E3 can be done depending on the bit processing the first set E1. Thus, to an even-order bit B2 processing the first set E1 of rows, there may correspond an even-order row Y4 of the second set E2 of rows and to an odd-order bit B1 there may correspond an odd-order row Y1. A permutation among all the rows of the second set substantially improves the homogeneity of the luminous background obtained. Other choices are possible, the main point being that of changing the row that contributes to the ionization. The change of row may also be done within several sets of rows.

To further improve the ionization of the panel without increasing the luminous background, an approach may be envisaged where this method of control with preconditioning write operations is combined with a method for keeping one or more additional rows located outside its useful surface permanently lit up during the operation of the panel, these rows being concealed from an observer. It is assumed that the rows Yc1, Yc2 that can be seen in FIG. 5*a* come under this category.

Let us take a color display panel using 10 bits for the display of the half-tones.

If, during an image cycle, one and the same row of a second set contributes to the ionization during all the operations for the processing of a first set, if the first and second sets are processed successively by the same bit and if the row contributing to the ionization is lit up during the maximum amount of time, it will remain lit for 100 sustaining cycles per image cycle. It will be over-bright.

If it is lit up for only a quarter of the maximum time, it will remain lit up for about 25 sustaining cycles per image cycle.

If the second set of rows has four rows and if a permutation is carried out on the rows of this set contributing to the ionization, each of them will remain lit up for only six sustaining cycles per image cycle. The luminous background will is spread in the second group.

If maintaining the ionization is not necessary for all the bits of the first set but for half of them, each row contributing to the ionization will remain lit up for only three sustaining cycles per image cycle. This duration is practically imperceptible to the eye.

The following example shows that the contrast C is good in a display panel controlled by the method according to the invention.

The value of the contrast C is equal to:

$$C=Lup/Luf$$

Lup represents the maximum luminance of the panel and is proportional to:

Ixb/a with:

I being the number of rows of the display panel, b being the number of bits used to display half-tones, a being the number of addressing operations during an image cycle, Luf represents the luminance of the luminous background introduced by the lighting up of the rows contributing to the ionization and is proportional to:

nxbxf/a with:

n as the number of sustaining cycles during which a row contributing to the ionization remains lit up, f being the ratio of the number of bits using this aid to ionization to the total number of bits.

By simplifying, we get:

$$C=I/nxf$$

If I=500, $n \leqq 3$ and f=0.5, we then obtain a contrast $C \geqq 300$ which is a value that is highly acceptable, imperceptible and, in any case, far smaller than that obtained in the display panels where all the rows are processed simultaneously in the same way as described in FIG. 3*b*.

This contrast value is the result of a compromise between the number of rows of the display panel, the number of bits for which the aid to ionization is applied and the number of sustaining cycles during which the rows contributing to the ionization are lit up.

Figure 5A:
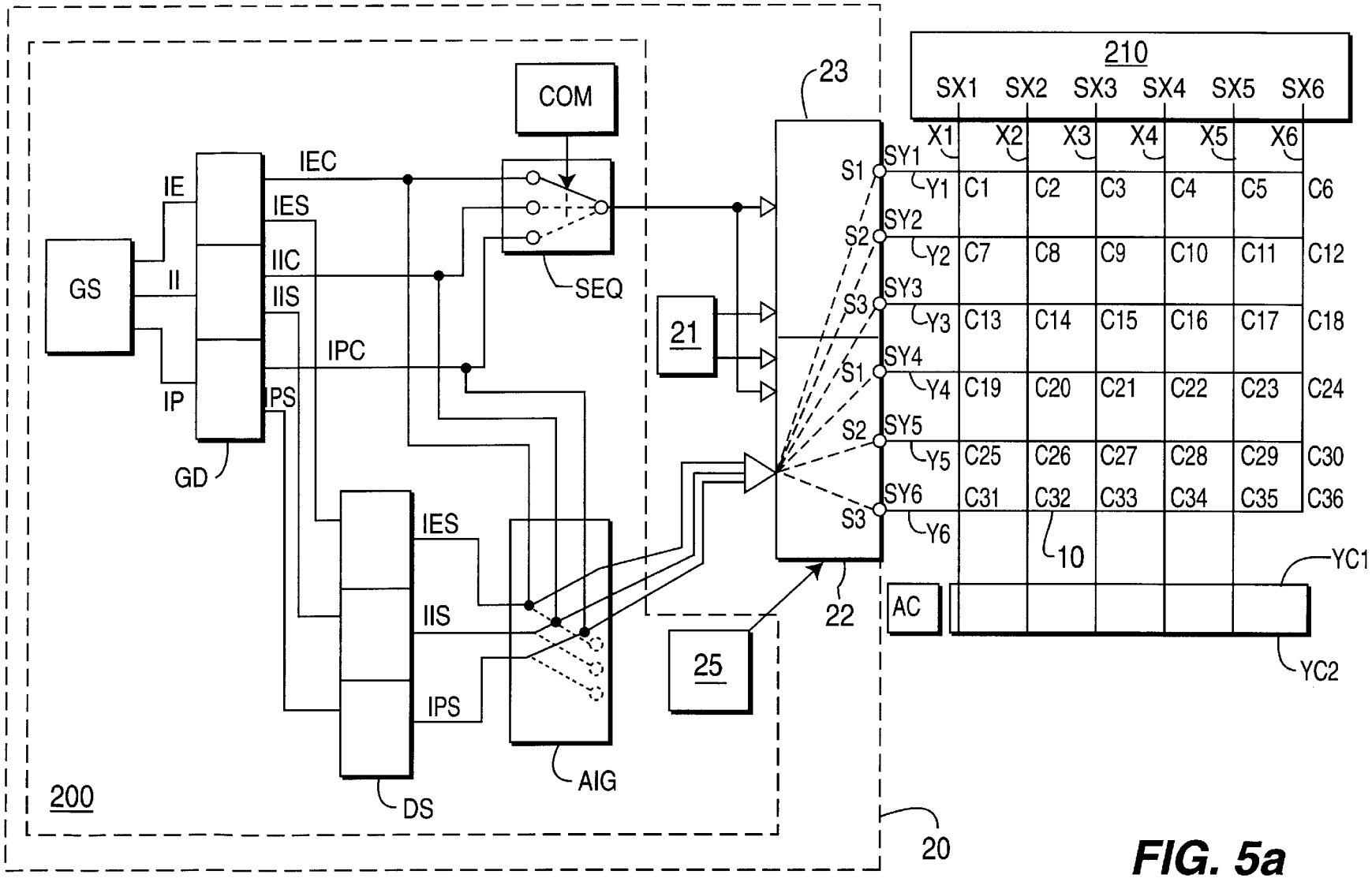
FIGS. 5*a*, 5*b* show two embodiments of a display panel controlled by the method of the invention.
Figure 5B:
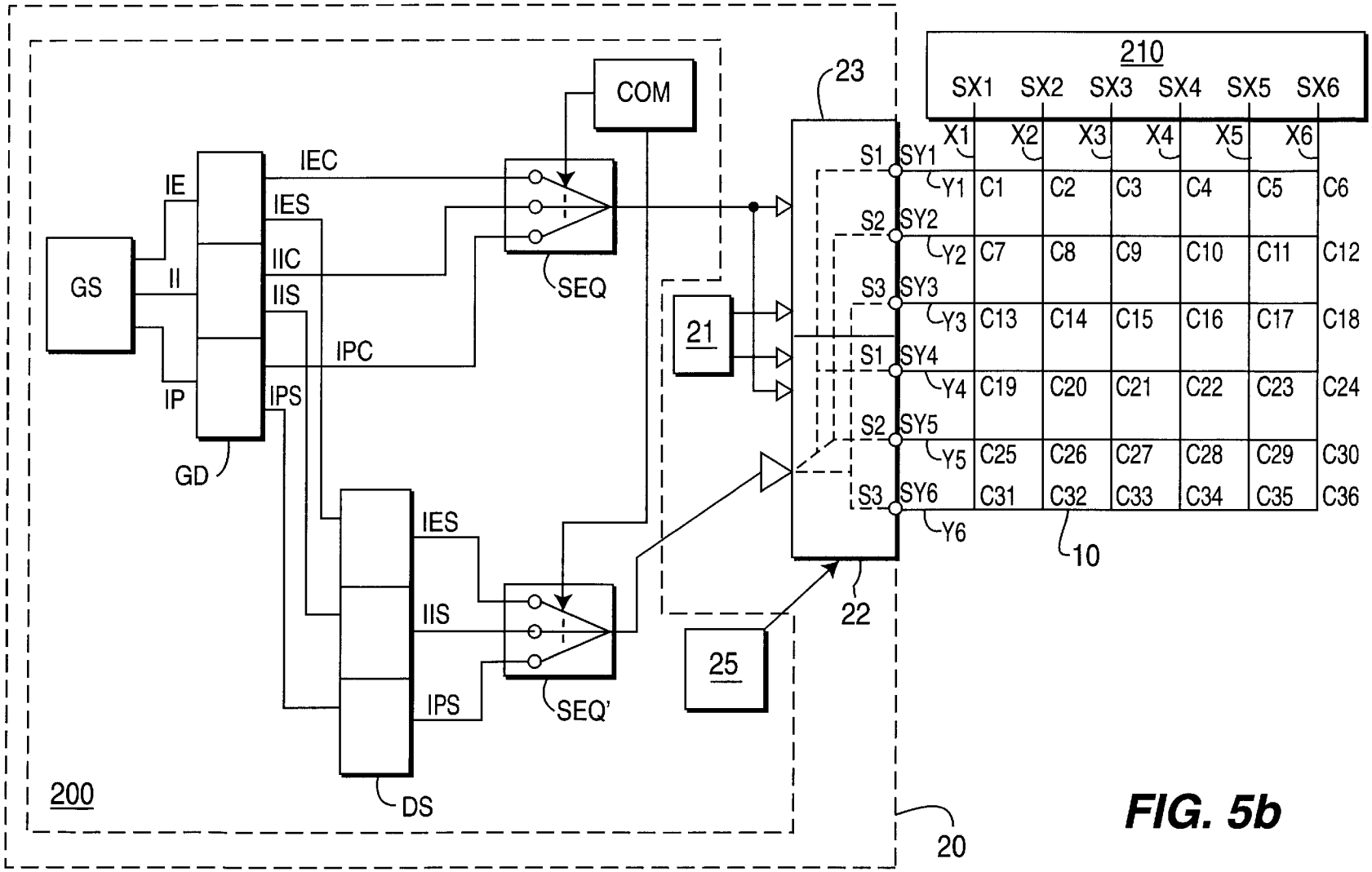

FIGS. 5*a* and 5*b* which are now referred to illustrate two variants of plasma panels implementing the addressing control method according to the invention.

The plasma panel has a useful screen 10 formed by means of an array of row electrodes or rows Y1 to Y6 intersected with a second array of column electrodes or columns X1 to X6.

At each row and column intersection, there is a cell C1 to C36. In the figures, there are only six rows and six columns, but a plasma panel for television applications may comprise more than a thousand of them and define more than a million cells.

Each row Y1 to Y6 is connected to an output SY1 to SY6 of a row management device 20 and each column X1 to X6 has an output SX1 to SX6 of a column management device 210.

The column management device 210 has the function especially of applying, to the columns X1 to X6, the masking pulses IM2, IM3, . . . applied to certain columns during the addressing as can be seen in FIG. 3*a*.

The row management device 20 comprises one or more row drivers 22, 23. Each row driver has a certain number of outputs S1, S2, S3, all these outputs forming the outputs of the row management device 20. Each of the row drivers 22, 23 permanently receives the sustaining signal EN delivered by one or more sustaining generators 21 and this sustaining signal is transmitted simultaneously to all the rows Y1 to Y6 of the display panel.

In the example shown, there are two row drivers 22, 23 each having three outputs S1, S2, S3 each connected to a row Y1 to Y3 and Y4 to Y6.

The row management device 20 also has an addressing device 200 cooperating with the sustaining generator 21. This addressing device 200 will transmit erasure signals IE, writing signals II and preconditioning write signals IP at the right times to outputs to be activated of the right row drivers, these signals being interposed on the sustaining signals EN.

The sustaining generator 21 is itself a standard one and shall not be described.

In FIG. 5*a*, the addressing device 200 works in parallel mode while in FIG. 5*b* it works in series mode.

FIG. 5*a* also shows two additional rows Yc1, Yc2 outside the useful screen 10. These two additional rows Yc1, Yc2 are masked from an observer. During the operation of the panel, they are permanently lit up to improve the ionization at the edge of the image as mentioned here above. They are connected for this purpose to a device AC delivering a conditioning signal.

The addressing device 200 of FIG. 5*a* has a signal generator GS which delivers signals of three types, namely erasure signals IE, write signals II and preconditioning write signals IP, to a data generator GD. The data generator GD delivers each of the signals that it receives accompanied by an identification of an addressee row driver 22, 23. The signals that it delivers bear the references IEC, IIC, IPC. They reach a sequencer SEQ controlled by a control device COM. These signals IEC, IIC, IPC, including the identification of an addressee row driver, are transmitted sequentially, each at a given point in time, to the addressee row driver 22, 23.

The data generator GD also delivers each of the signals that it receives to an active output selection device DS, accompanied by an identification of one or more row driver outputs to be activated. The signals that it delivers are referenced IES, IIS, IPS.

The erasure signals IE are applied simultaneously to several outputs when the addressing is done on the rows, set by set, and when each set of rows comprises several rows whereas the write signals II and the preconditioning signals IP are applied to only one output.

The signals IES, IIS, IPS including the identification of said output or outputs to be activated reach a routing device AIG in parallel mode and are routed simultaneously in packets of three different types, each towards to said output or outputs to be activated of the addressee row driver. For this purpose, the routing device AIG also receives the signals IEC, IIC, IPC including the identification of the addressee row driver. This transmission in packets of three signals of different types makes it possible to save time.

A row driver 22, 23 enables the transmission of a signal present at one of its outputs to the corresponding row Y1 to Y6 at the instant chosen when it receives a signal of the same type coming from the sequencer SEQ.

The row drivers 22, 23 may also receive additional signals, suited to their needs, from a control circuit 25.

FIG. 5*b* shows the signal generator GS delivering signals of the three types IE, II, IP. The data generator GD delivers the signals of all three types including the identification of the addressee row driver, the signals of the three types including the identification of the output or outputs of the row driver to be activated. The figure also shows the control circuit 25 and the sequencer SEQ which carries out the sequential transmission, at chosen points in time, of the signals including the addressee row driver identification to said addressee row driver. The difference lies at the level of the differentiation of the output or outputs to be activated of the row drivers 22, 23.

The signals IES, IIS, IPS including the identification of said output or outputs to be activated reach a second sequencer SEQ' controlled in synchronism with the first sequencer SEQ. The second sequencer SEQ' carries out the sequential transmission, at the same chosen points in time, of the signals of the same type as those transmitted by the first sequencer SEQ but including said output or outputs to be activated, towards all the row drivers 22, 23 having one or more such outputs to be activated.

A row driver 22, 23 enables the transmission of a signal received from the second sequencer SEQ' to the row corresponding to the output to be activated when, at the same point in time, it has received a signal of a same type coming from the first sequencer SEQ.

For example, the signal generator GS may be formed by a counter, the data generator GD and the selection device DS may be formed by memories, the sequencers SEQ, SEQ' may be formed by switches with three inputs and one output and the routing device may be formed by a multiplexer.

Figure 6A:
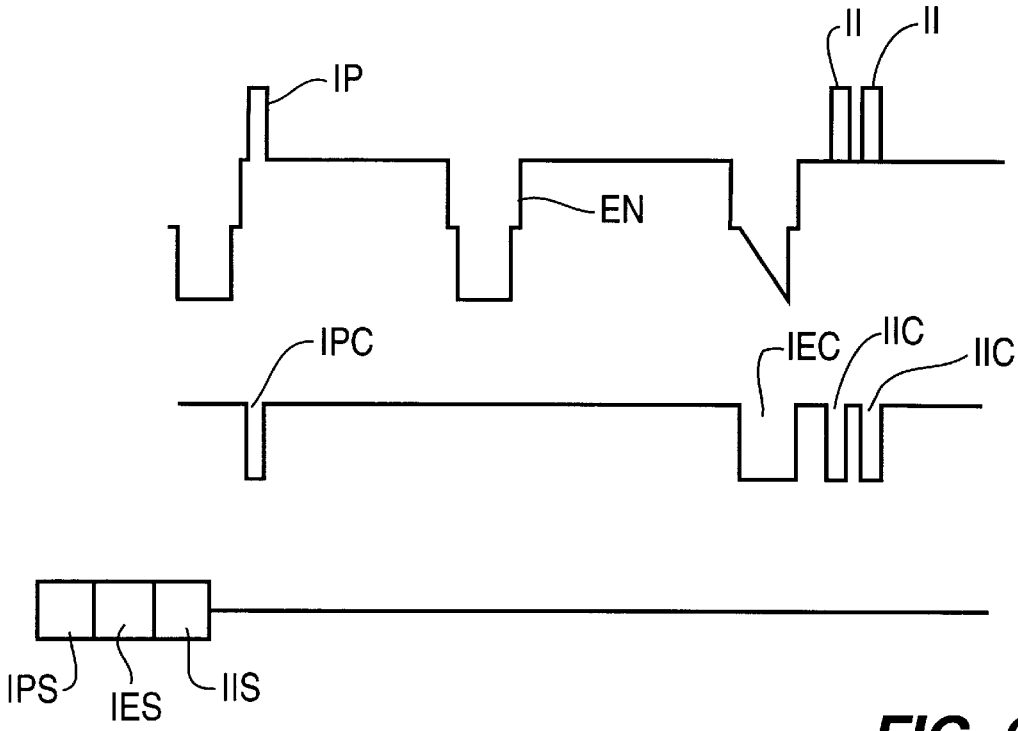
FIGS. 6*a*, 6*b* are timing diagrams showing the signals applied to the rows of the two display panels of FIGS. 5*a*, 5*b*.
Figure 6B:
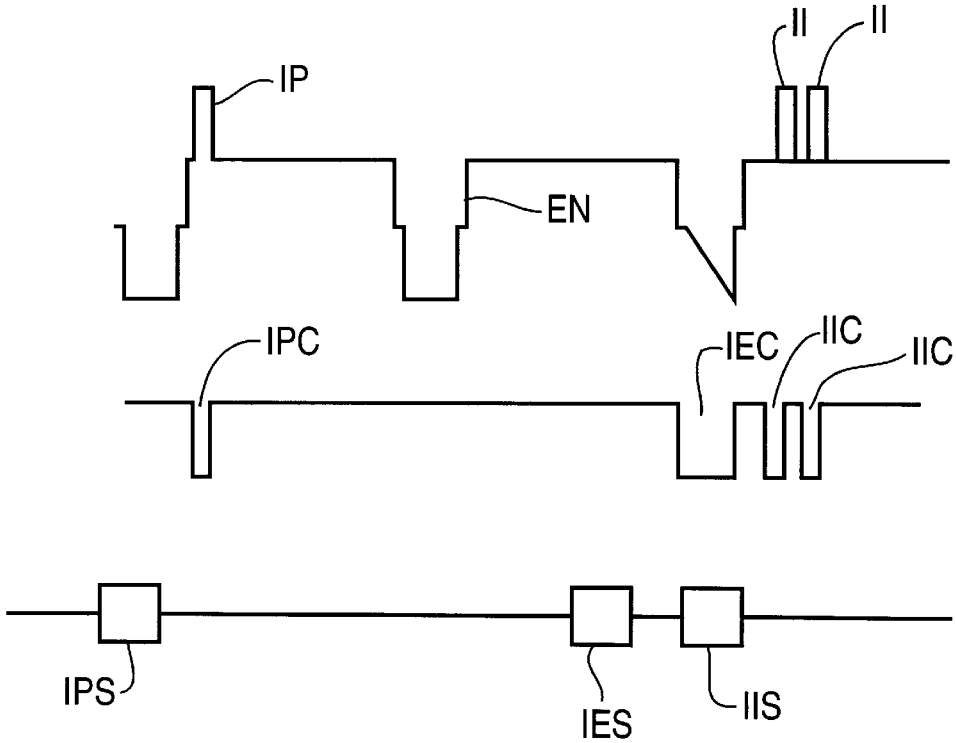

FIGS. 6*a*, 6*b* show timing diagrams of the signals IEC, IIC, IPC, IES, IIS, IPS reaching the row drivers respectively in the parallel mode and in the serial mode with, for each figure, the signals received on a row.

The parallel mode has the advantage of saving time in the loading of the data elements into the components. This is particularly sought after when the panel to be controlled has a large number of rows and columns and is used for television applications.

What is claimed is:

1. A method for the control of a color alternating display panel comprising cells arranged in rows and columns, these cells having two states, one written and the other extinguished, the rows forming at least two sets, each set comprising at least one row, the method comprising at least the following steps:

the application, to the rows, of a sustaining signal formed by a succession of sustaining cycles and generating sustaining discharges in the written-in cells, the addressing, at appropriate points in time, of the sets of rows, the addressing operation being done on the sets of rows, set by set, and comprising a semi-selective operation followed by a selective operation, one of the operations being a writing operation and the other operation being an erasing operation, wherein, after at least one semi-selective operation pertaining to the first set, the method consists in performing a preconditioning write operation on the cells of at least one row of the second set, whatever the state of the cells of the row, this preconditioning write operation taking place outside an addressing time of the second set and outside the selective operation that follows the semi-selective operation pertaining to the first set.

2. The method according to claim 1, wherein the sustaining signal comprises plateaux linked by transitions, and wherein the preconditioning write operation is performed by a pulse superimposed on a plateau.

3. The method according to claim 2, wherein the preconditioning pulse occurs just after a transition, at a point in time at which a sustaining discharge should occur in the written-in cells in the absence of any preconditioning pulse.

4. The method according to claim 1 wherein the semi-selective and selective operations are, in one case, an erasure operation and, in the other case, a write operation, and wherein the preconditioning write operation occurs at the closest possible point to an erasure of the row of the second set, so as to reduce the time taken to write in this row.

5. The method according to claim 4, wherein the preconditioning write operation takes place at least one sustaining cycle before the erasure of the row of the second set.

6. The method according to claim 1, wherein, in order to display an image with half-tones, each set is subjected to several successive processing operations, a processing operation consisting of an addressing operation followed by at least one sustaining cycle, each processing operation being associated with a control bit whose value represents the duration of the processing.

7. The method according to claim 6, wherein the two sets are processed successively by the same bit.

8. The method according to claim 6, wherein the preconditioning write operation is carried out during at least one operation for the processing of the first set.

9. The method according to claim 8, wherein the processing is associated with a low-value bit.

10. The method according to claim 6, wherein the row of the second set written in by the preconditioning write operation changes according to the control bit processing the first set.

11. The method according to claim 10, wherein the change takes place within the same second set.

12. The method according to claim 10, wherein the change consists of a permutation among the rows of the second set.

13. The method according to claim 10, wherein the change takes place within several sets of rows.

14. The method according to claim 2, wherein the writing operation is done by a pulse superimposed on a plateau, and wherein the pulse that performs the preconditioning write operation has an amplitude different from the pulse that carries out the write operation.

15. The method according to claim 1, wherein the method consists in keeping one or more additional rows of the panel in a permanently written-in state, these rows being masked from an observer.

16. A color alternating display panel comprising:

cells placed at the crossing of at least one array of row electrodes or rows with at least one array of column electrodes or columns, the rows forming at least two sets of at least one row, a row management device and a column management device delivering signals to the rows and to the columns, the row management device comprising:

at least one sustaining generator that delivers sustaining signals to all the rows by means of at least one row driver, each row being connected to an output of the row driver, and an addressing device supplying the rows, through an output to be activated of an addressee row driver, after the enabling of the row driver, with signals of three types that are superimposed on the sustaining signals, comprising: erasure signals and writing signals, one of these signals forming a semi-selective operation and the other a selective operation, an addressing consisting of a semi-selective operation followed by a selective operation, the signals corresponding to an addressing operation being delivered to the rows of the sets, set by set, and preconditioning write signals, wherein the addressing device, after a semi-selective operation related to the first set, delivers these preconditioning write signals to the cells of at least one row of the second set, whatever the state of the cells of the row, in doing so outside the addressing time of the second set and outside the selective operation of the first set.

17. The display panel according to claim 16, wherein the addressing circuit comprises:

a signal generator delivering signals of all three types, means to deliver, firstly, each signal accompanied by an identification of an addressee row driver and, secondly, each signal accompanied by the identification of one or more row driver outputs to be activated, means for the sequential transmission, at a selected point in time, of each signal accompanied by the identification of the addressee driver towards said addressee row driver, means for the simultaneous routing, in packets of three different types, of the signals accompanied by the identification of said output or outputs to be activated towards said output or outputs to be activated of the addressee row driver.

18. The display panel according to claim 17, wherein a row driver enables the transmission of a signal received at one of its outputs, towards the corresponding row, at the selected point in time when it receives a signal of the same type from the sequential transmission means.

19. The display panel according to claim 16, wherein the addressing circuit comprises:

a signals generator delivering signals of all three types, means to deliver, firstly, each signal accompanied by an identification of an addressee row driver and, secondly, each signal accompanied by an identification of one or more outputs, to be activated, of a row driver, first means for the sequential transmission, at a selected point in time, of each signal accompanied by the identification of the addressee row driver to said addressee row driver, second means for the sequential transmission, at the same selected point in time, of a signal of the same type accompanied by the identification of said output or outputs to be activated towards said output or outputs to be activated of all the addressee row drivers having one or more such outputs.

20. The display panel according to claim 19, wherein a row driver enables the transmission of a signal received from the second means of sequential transmission towards the row corresponding to the output to be activated when it has received, at the same point in time, the signal of a same type coming from the first sequential transmission means.

* * * * *